United States Patent [19]

Rudnick

[11] Patent Number: 4,581,131

[45] Date of Patent: Apr. 8, 1986

[54] METHOD FOR REMOVAL OF PHENOLIC MATERIALS FROM MIXTURES THEREOF

[75] Inventor: Leslie R. Rudnick, Lawrenceville, N.J.

[73] Assignee: Mobil Oil Corporation, New York, N.Y.

[21] Appl. No.: 674,433

[22] Filed: Nov. 23, 1984

[51] Int. Cl.[4] ..... C10G 25/00

[52] U.S. Cl. ..... 208/263; 208/295; 208/299; 208/91

[58] Field of Search ..... 208/263, 295, 299, 91; 423/245; 585/820

[56] References Cited

U.S. PATENT DOCUMENTS

| | | | |
|---|---|---|---|
| 1,953,336 | 4/1934 | Campbell | 208/263 |
| 2,795,535 | 6/1957 | Crosby et al. | 208/263 |
| 3,617,531 | 11/1971 | Schlicht et al. | 208/263 |
| 3,979,287 | 9/1976 | Vulliez-Sermet et al. | 208/263 |
| 4,045,331 | 8/1977 | Ward | 208/253 |
| 4,222,897 | 9/1980 | Rollmann | 502/400 |

*Primary Examiner*—Andrew H. Metz
*Assistant Examiner*—Helane Myers
*Attorney, Agent, or Firm*—Alexander J. McKillop; Michael G. Gilman; Van D. Harrison, Jr.

[57] ABSTRACT

Phenolic compounds are removed from a hydrocarbon oil by contacting the oil with manganese nodules at suitable conditions of contact time, temperature, and pressure.

5 Claims, 2 Drawing Figures

METHOD FOR REMOVAL OF PHENOLIC MATERIALS FROM MIXTURES THEREOF

NATURE OF THE INVENTION

This invention relates to the processing of liquid hydrocarbon mixtures, particularly petroleum-based heavy oils and residual oils containing phenols. This invention is particularly concerned with the removal of cyclic and polycyclic aromatic compounds having phenol groups attached thereto.

Phenolic materials occur in hydrocarbon fossil fuels such as petroleum liquids, tar sand oil, and coal liquids.

The phenolic OH found in these materials, particularly polycyclic aromatic compounds of tar sand oil causes a significant increase in the oil's viscosity due to hydrogen bonding.

For purposes of the present disclosure and claims the terms "phenolic oxygen" is used to identify the oxygen in the OH group attached to polycyclic aromatic compounds. The term "polycyclic compounds" includes dicyclic compounds.

It is an object, therefore, of the present invention to produce a hydrocarbon oil from these sources having a lower phenolic oxygen content so that the oil may be transported and processed in conventional pumping and processing equipment currently employed in the petroleum industry. Still another object of this invention is to provide a process for removing phenols from mixtures of chemicals or hydrocarbon streams.

SUMMARY OF THE INVENTION

In accordance with the present invention, it has been found that the phenolic oxygen content of various streams such as lubricant oils, gas oils, petroleum distillate, coal liquids and the like can be significantly reduced by contacting the oil with manganese nodules. This invention is directed to a process for removing phenolic oxygen primarily from heavy petroleum oils which comprises contacting the heavy petroleum oil containing polycyclic hydroxy aromatic compounds with particulated manganese nodules at temperatures and pressures set forth herein and subsequently separating the heavy petroleum oil from the nodules.

DESCRIPTION OF THE PREFERRED EMBODIMENTS

Broadly, the present invention is practiced by mixing a heavy oil containing between 0.001 and 20 percent by weight of polycyclic hydroxy aromatic compounds with a selective sorbent material consisting essentially of manganese nodules at a temperature between about 20 and about 175° F. and a pressure of atmospheric pressure approximately and thereafter separating the heavy oil fraction from the solid sorbent material.

Manganese nodules are a naturally occurring underwater deposit of a rock-like solid. These deposits, found on the bottoms of bodies of water, contain a high content of manganese mineral associated with other metals including iron, cobalt, nickel and copper. They are found in abundance in the Atlantic and Pacific oceans and in Lake Michigan. The nodules are characterized by a large surface area, i.e., in excess of about 100 square meters per gram. They have a wide variety of shapes but most often those from the ocean look like potatoes, while those from bodies of fresh water, such as Lake Michigan, tend to be smaller in size. Their color varies from black to brown depending on the relative manganese and iron content. The nodules are porous and light, having an average specific gravity of 2.4. In general, they range from ⅛ to 9" in diameter but may extend up to considerably larger sizes, approaching 4 feet in length and 3 feet in diameter and weighing as much as 1700 pounds. In addition to the metals mentioned above, the nodules contain silicon, aluminum, calcium, and magnesium, and small amounts of molybdenum, zinc, lead, vanadium and rare earth metals. The manganese nodules substantially as mined are recovered from the floor of the body of water in which they occur and after washing to remove salt or mud or other loose material, are crushed and sized to obtain a desired particle size. A preferred particle size is 12/28 mesh. Further information on manganese nodules is contained in U.S. Pat. No. 4,222,897 which is incorporated herein by reference. To effect treatment of the hydrocarbon liquid containing the phenolic material, the liquid hydrocarbon is passed in contact with the manganese nodules at a temperature preferably between about 20° and about 175° F., a pressure between about 15 and about 60 psig, and an LHSV between about 0.5 and about 4.

During the time of contact between the particulated manganese nodules and the liquid hydrocarbon the phenolic compounds are adsorbed onto the manganese nodule material. When the capacity of the manganese nodule material is exhausted it can be treated to remove the sorbed phenolic compounds or can be discarded as desired. The feedstock after being contacted with the manganese nodules is then passed to further treating and refining operations.

EXAMPLE

Figure 1A:
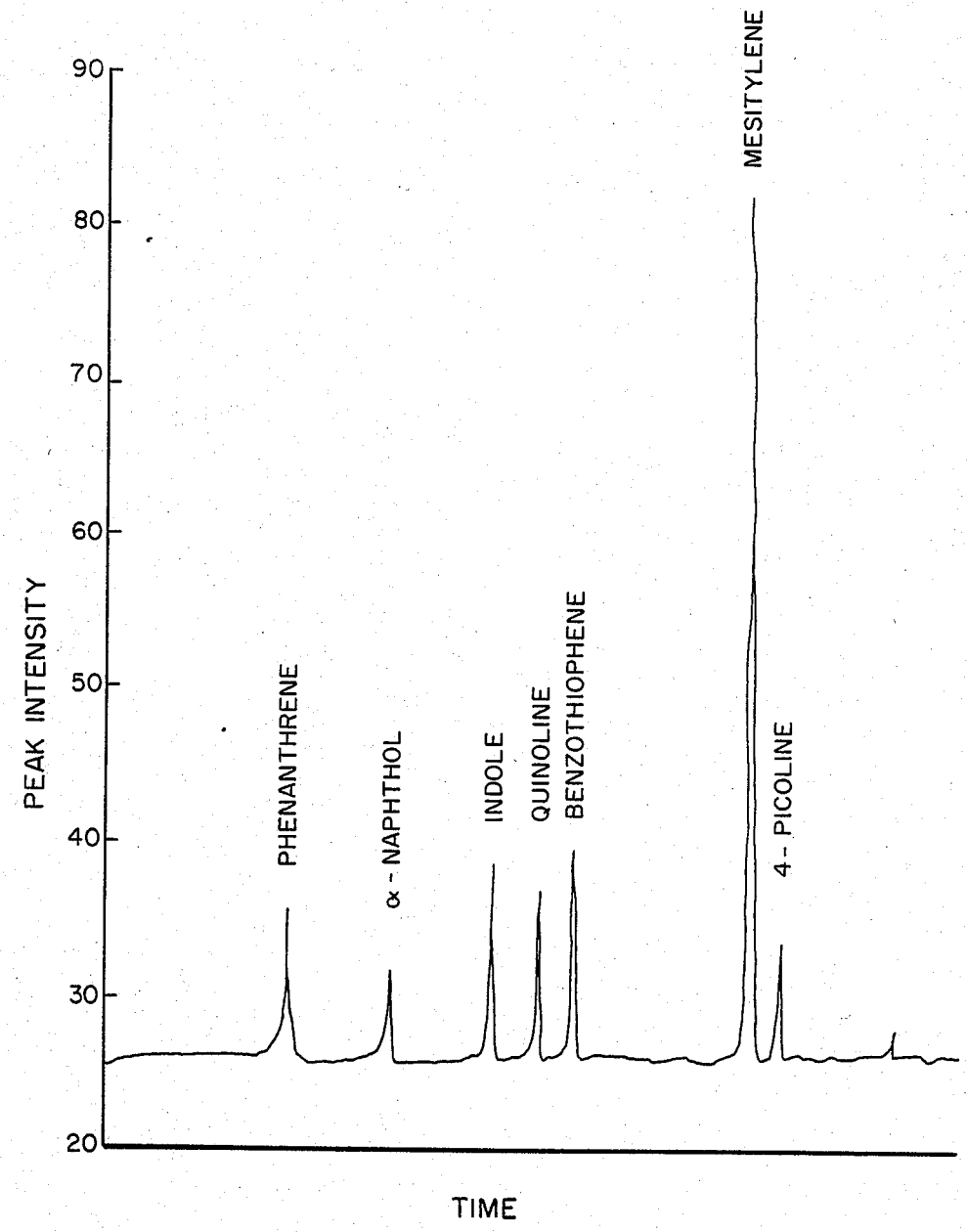
FIGS. 1A and 1B are chromatgrams of a hydrocarbon sample containing phenolic compounds before and after contact with manganese nodules.
Figure 1B:
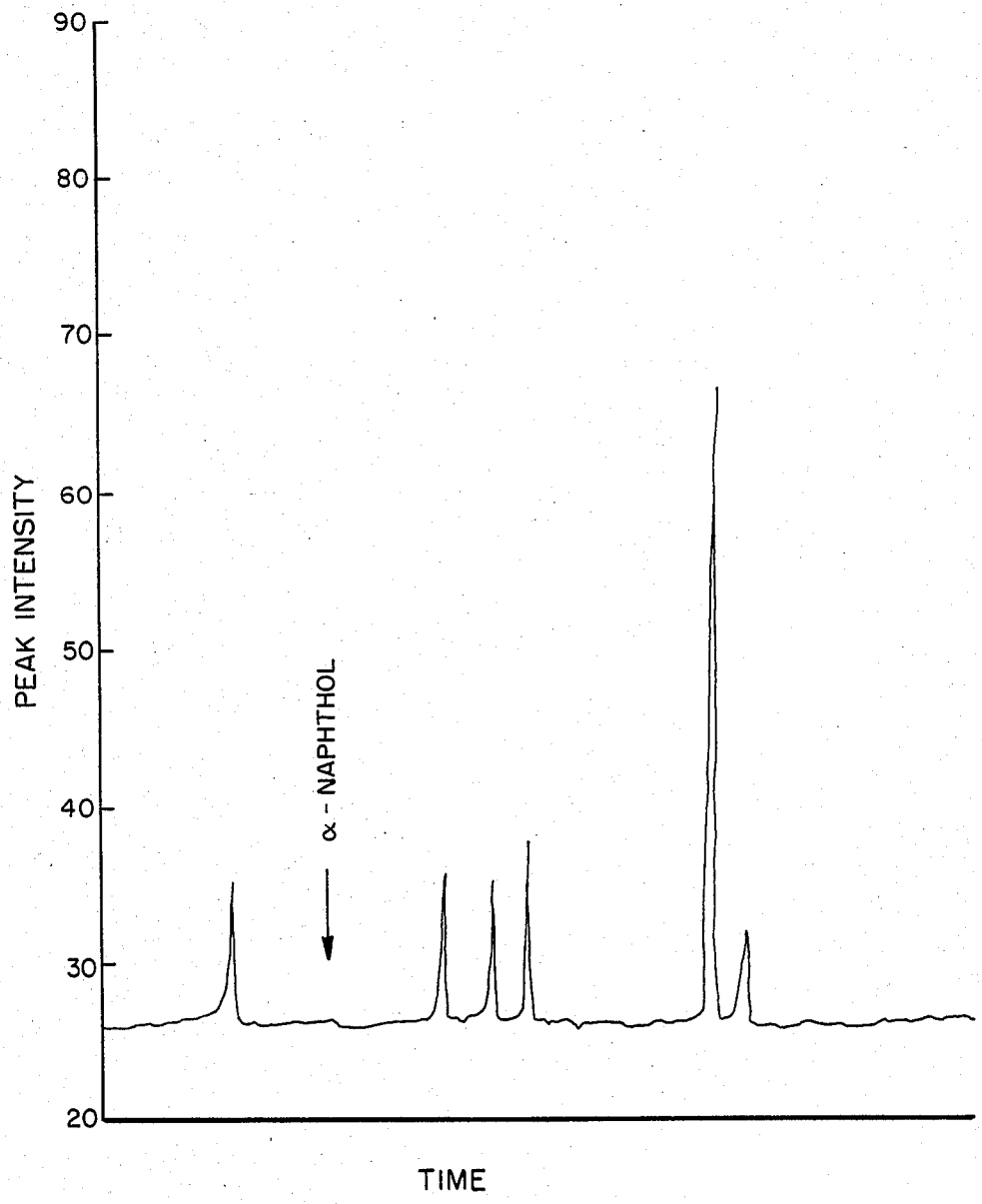

To approximately 1 milliliter of a mixture of compounds known to be present in fossil fuel materials, there was added 0.2 grams of manganese nodules (Blake Plateau), 12/28 mesh. The mixture of manganese nodules and hydrocarbon was agitated over a period of time and the composition of the liquid phase of the mixture was thereafter analyzed by gas chromatography. FIG. 1A shows the analysis of the hydrocarbon mixture before treatment with manganese nodules. FIG. 1B shows the composition of material after treatment with manganese nodules. A comparison of the two readily shows that alpha naphthol was substantially removed from the mixture.

This process can be used to remove phenolic materials selectively from various streams such as lubricant oils, gas oils, petroleum distillate fractions, coal liquefaction products and process derived solvents. This invention also has application to treating vegetable oils in the food industry and can be used for removing phenolics in the solution of environmental and disposal problems.

I claim:

1. A process for removing phenolic oxygen from heavy petroleum oils which comprises contacting the heavy petroleum oil with particulated manganese nodules and thereafter separating said nodules from contact with said heavy petroleum oils.

2. A process according to claim 1 wherein the heavy petroleum oil is tar sands oil.

3. A process according to claim 1 wherein the heavy petroleum oil is crude oil, reduced crude or residual oil.

4. A process according to claim 1 wherein the contacting of said hydrocarbon mixture and said manganese nodules is conducted at a temperature between about 20° and about 175° F.

5. The process according to claim 1 wherein the concentration of phenolics in said hydrocarbon oil is between about 0.001 and about 20% by weight.

* * * * *